US005822722A

United States Patent [19]

Ozawa

[11] Patent Number: 5,822,722

[45] Date of Patent: Oct. 13, 1998

[54] WIDE-BAND SIGNAL ENCODER

[75] Inventor: Kazunori Ozawa, Tokyo, Japan

[73] Assignee: NEC Corporation, Tokyo, Japan

[21] Appl. No.: 606,805

[22] Filed: Feb. 26, 1996

[30] Foreign Application Priority Data

Feb. 24, 1995 [JP] Japan ..... 7-036662

[51] Int. Cl.[6] ..... G10L 9/14

[52] U.S. Cl. ..... 704/222; 704/219; 704/222; 704/229; 704/230

[58] Field of Search ..... 704/222, 205, 704/203, 200, 201, 204, 226, 227, 219, 229, 230, 231, 232, 500, 501

[56] References Cited

U.S. PATENT DOCUMENTS

| | | | |
|---|---|---|---|
| 4,677,671 | 6/1987 | Galand et al. | 704/212 |
| 5,151,941 | 9/1992 | Nishiguchi | 704/262 |
| 5,414,795 | 5/1995 | Tsutsui et al. | 395/2.13 |
| 5,471,558 | 11/1995 | Tsutsui | 395/2.28 |
| 5,488,665 | 1/1996 | Johnston et al. | 381/2 |
| 5,535,300 | 7/1996 | Hall, II et al. | 395/2.36 |
| 5,592,584 | 1/1997 | Ferreira et al. | 395/2.12 |
| 5,651,090 | 7/1997 | Moriya et al. | 395/2.31 |
| 5,666,465 | 9/1997 | Ozawa | 704/222 |

FOREIGN PATENT DOCUMENTS

| | | | |
|---|---|---|---|
| 0 111 612 | 6/1984 | European Pat. Off. | H04B 1/66 |
| 0 267 344 | 5/1988 | European Pat. Off. | H04B 1/66 |
| 0 396 121 | 11/1990 | European Pat. Off. | G10L 9/14 |

OTHER PUBLICATIONS

Johnston, "Transform Coding of Audio Signals Using Perceptual Noise Criteria", *IEEE Journal on Selected Areas in Communications*, vol. 6(2):314–323, Feb. 1988.

Princen et al., "Analysis/Synthesis Filter Bank Design Based on Time Domain Aliasing Cancellation", *IEEE Transactions on Acoustics, Speech, and Signal Processing*, vol. ASSP–34(5):1153–1161, Oct. 1986.

Linde et al., "An Algorithm For Vector Quantizer Design", *IEEE Transactions on Communications*, vol. COM–28(1):84–95, Jan. 1980.

Wang et al., "An Objective Measure For Predicting Subjective Quality of Speech Coders", *IEEE Journal On Selected Areas in Communications*, vol. 10(5):819–829, Jun. 1992.

Sugamura et al., "Quantizer Design in LSP Speech Analysis–Synthesis", *IEEE Journal on Selected Areas in Communications*, vol. 6(2):432–440, Feb. 1988.

Vaidyanathan, "Multirate Digital Filters, Filter Banks, Polyphase Networks, and Applications: A Tutorial", *Proceedings of the IEEE*, vol. 78(1):56–93, Jan. 1990.

*Primary Examiner*—Richemond Dorvil
*Attorney, Agent, or Firm*—Foley & Lardner

[57] ABSTRACT

A block length judging circuit 120 switches block lengths based on a feature quantity obtained from an input signal. A transform circuit 200 executes transform of the signal into frequency components according to the block length. A masking threshold calculating circuit 250 calculates a masking threshold simulating the masking characteristic of psychoacoustical property for each predetermined intra-block section. An inter-block/intra-block bit assignment circuit 300 executes inter-block bit number assignment and/or intra-block bit number assignment to each predetermined intra-block section. A vector quantization circuit 350 vector quantizes transform signal by switching codebooks $\mathbf{360}_1$ to $\mathbf{360}_N$ according to the assignment bit number, and also quantizes gain by using a gain codebook 370.

20 Claims, 10 Drawing Sheets

WIDE-BAND SIGNAL ENCODER

BACKGROUND OF THE INVENTION

The present invention relates to wide-band signal encoders for high quality encoding wide-band signals such as an audio signal, with low bit rates, particularly about 64 kb/s.

As a system for encoding a wide-band signal such as an audio signal with a low bit rate, typically about 128 kb/s, per channel, a well-known audio encoding system is disclosed in Johnston et al, "Transform Coding of Audio Signals Using Perceptual Noise Criteria", IEEE J. Sel. Areas Commun., pp. 314–323, 1988 (Literature 1).

In the method disclosed in Literature 1, on the transmitting side an input signal is converted into frequency components through FFT for each block (for instance 2,048 samples), the FFT components thus obtained are then divided into 25 critical bands, an acoustical masking threshold is then calculated for each masking threshold, and a quantization bit number is assigned to each critical band on the basis of the masking threshold. In addition, the FFT components are scalar quantized according to the quantization bit numbers. The scalar quantization information, bit assignment information and quantization step size information are transmitted in combination for each block to the receiving side. The receiving side is not described.

In the above prior art method shown in Literature 1, (1) the quantization efficiency is not so high because of the scalar quantization used for the quantization of the FFT components, and (2) no inter-block bit assignment is provided although bit assignment is made for intra-block FFT components so that sufficient gain due to the bit assignment can not be obtained for transient signals. Therefore, bit rate reduction down to about 64 kb/s results in quantization efficiency reduction to greatly deteriorate the sound quality.

SUMMARY OF THE INVENTION

According to a first aspect of the present invention, a block length is determined by obtaining a feature quantity from an input signal, and transform of the input signal into frequency components is executed for each block length. The transform that is conceivable is MCDT (Modified Discrete Cosine Transform), DCT (discrete cosine transform) or transform with band division band-pass filter bank. For details of the MDCT, reference may be had to Princen et al, "Analysis-Synthesis Filter Bank Design Based on Time Domain Aliasing Cancellation", IEEE Trans. ASSP, pp. 1153–1165, 1986 (Literature 2). Masking threshold is obtained from the output of the transform circuit or from the input signal on the basis of an acoustical masking characteristic, and an inter-block quantization bit number and/or assignments of an intra-bit quantization bit number corresponding to transform circuit output vector are determined on the basis of the masking threshold. The transform output signal is vector quantized using a codebook of a bit number corresponding to the bit assignment, and an optimum codevector is selected from the codebook.

According to a second aspect of the present invention, a prediction error signal is obtained through prediction of a transform signal for the present block from a quantized output signal for a past block. Masking threshold is obtained from the transform output, the input signal or the prediction error signal on the basis of an acoustical masking characteristic. Assignments of the inter-block quantization bit number and/or the intra-block quantization bit number corresponding to transform output vector are determined on the basis of the obtained masking threshold. The transform output signal is vector quantized using a codebook of the bit number corresponding to the bit assignment, and an optimum codevector is selected from the codebook.

According to a third aspect of the present invention, a prediction error signal is obtained by predicting the transform output signal for the present block by using the quantized output signal for a past block and a prediction signal for a past block. Masking threshold is obtained from the transform output, the input signal or the prediction error signal on the basis of an acoustical masking characteristic. Assignment of the intra-block quantization bit number is determined on the basis of the masking value. The transform output signal is vector quantized using a codebook of a bit number corresponding to the bit assignment.

A fourth aspect of the present invention eliminates the block length judging circuit and the inter-block bit assignment from the encoder according to the second aspect of the present invention.

A fifth aspect of the present invention eliminates the block length judging circuit and the inter-block bit assignment from the encoder according to the third aspect of the present invention.

In a sixth aspect of the present invention, the transform output or the prediction error signal in the encoder according to one of the first to fifth aspects of the present invention is vector quantized while weighting the signal by using the masking threshold.

In a seventh aspect of the present invention, the transform output or the prediction error signal in the encoder according to one of the first to fifth aspects of the present invention is vector quantized after processing the signal on the basis of psychoacoustical property.

In an eighth aspect of the present invention, a low degree spectrum coefficient representing a frequency envelope of the transform output signal from the transform circuit or the prediction error signal according to one of the first to fifth aspects of the present invention is obtained, and the transform output or the prediction error signal is quantized by using the frequency envelope and the output of the bit assignment circuit.

Other objects and features will clarified from the following description with reference to attached drawings.

DETAILED DESCRIPTION OF THE PREFERRED EMBODIMENTS

Figure 1:
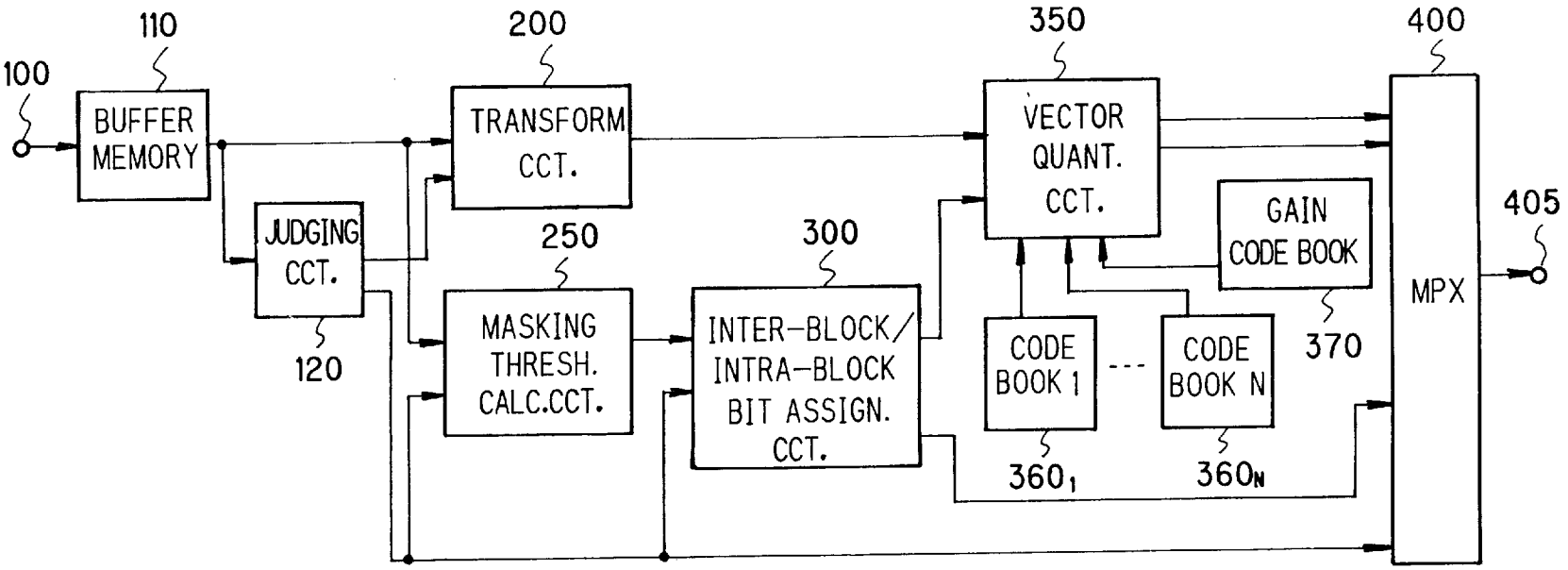
FIG. 1 is a block diagram showing an embodiment of a wide-band signal encoder according to a first aspect of the present invention.

Referring to FIG. 1 showing an embodiment of a wide-band signal encoder according to the first aspect of the present invention, in the transmitting side of a system, a wide-band signal is inputted from an input terminal 100, and one block of signal having a maximum block length (for instance 1,024 samples) is stored in a buffer memory 110. A block length judging circuit 120 switches the block length through a judgment using a predetermined feature quantity as to whether the intra-block signal is a transient or steady-state signal. In the circuit 120, a plurality of different block lengths are available. For the sake of the brevity, it is assumed that two different block lengths, for instance a 1,024-sample block and a 256-sample block, are made available. The feature quantity may be intra-block signal power changes with time, predicted gain, etc.

A transform circuit 200 receives a signal from the buffer memory 110 and block length data (representing either 1,024- or 256-sample block, for instance) from the block length judging circuit 120, takes out a signal in correspondence to the pertinent block length, multiples the taken-out signal by a window, and executes a transformation of MDCT on the multiplied signal. For details of the configuration of the window and the MDCT, see Literature 2, for instance. A masking threshold calculating circuit 250 receives the output of the block length judging circuit 120 and the output signal from the buffer memory 110 and calculates a masking threshold value corresponding to the signal for the block length. The masking threshold calculation may be made as follows. FFT is made on the input signal x(n) for the block length to obtain spectrum X(k) (k being 0 to N−1) and also obtain power spectrum $|X(k)|^2$, which is analyzed by using a critical band-pass filter or an acoustical model to calculate power or RMS for each critical band. The power calculation is made as follows.

$$B(i)=\Sigma_{k=bli}^{bhi}|X(k)|^2(i=1\ to\ R) \tag{1}$$

where $bl_i$ and $bh_i$ are the lower and upper limit frequencies in the i-st critical band. R represents the number of the critical bands included in the speech signal band. For the critical bands, see Literature 1 noted above.

Then, a variance function is convoluted to the critical band spectrum as $$Ci=\Sigma_{j=1}^{bmax}B_i sprd\ (j,i) \tag{2}$$

where sprd (j, i) is the variance function. For specific values of the function, reference may be had to Literature 1. $b_{max}$ is the number of critical bands contained up to angular frequency, π.

Then, masking threshold spectrum $T'_1$ is calculated as $$T'_i=C_iT_i \tag{3}$$

where $$T_i=10^{-(}Oi/\mathbf{10}) \tag{4}$$

$$O_i=\alpha(14.5+i)+1(1-\alpha)5.5 \tag{5}$$

$$\alpha=min_M[(NG/R),\ 1.0] \tag{6}$$

Here, NG is the predictability, and for its calculation method reference may be had to Literature 1 noted above. When the absolute threshold is taken into consideration, the masking threshold spectrum is expressed as $$T''_i=max[T_i,\ absth_i] \tag{7}$$

where $absth_i$ is the absolute threshold in the critical band i, and is taught in Literature 1 noted above.

The masking threshold spectrum data is outputted to an inter-block/intra-block bit assignment circuit 300. The inter-block/intra-block bit assignment circuit 300 receives the masking threshold for each critical band and the output of the block length judging circuit 120 and, when the block length is 1,204 samples, executes only the intra-block bit assignment. When the block length is 256 samples, the circuit 300 calculates the bit number $B_i$ (i being 1 to 4) of each of four successive blocks (i.e., a total of 1,024 samples), and then executes the intra-block bit assignment with respect to each of the four blocks. In the intra-block bit assignment, bit assignment is executed for each critical band.

The intra-block bit assignment is made as follows. Signal-to-masking threshold ratio $SMR_{ji}$ (j being 1 to $B_{max}$, i being 1 to 4, and $B_{max}$ being the number of critical bands), is obtained as $$R_i=R+½log_2[\Pi_{j=0}^{M-1}SMR_{ji}]^{1/M}/[\Pi_{i=1}^{L}\Pi_{j=0}^{M-1}SMR_{ji}]^{1/M\times L} \tag{8}$$

where $R_i$ is the number of assignment bits to the i-th sub-frame, R is the average bit number of quantization, M is the number of critical bands, and L is the number of blocks. Another method of bit assignment is as follows.

$$R_i=R+½log_2[\Sigma_{j=0}^{M-1}SMR_{ji}]^{1/M}/[\Pi_{i=1}^{L}\Sigma_{j=0}^{M-1}SMR_{ji}]^{1/M} \tag{9}$$

The bit assignment of critical band k in i-th block is $$R_{ki}=R+½log_2[SMR_{ki}]/[\Pi_{i=1}^{L}SMR_{ki}]^{1/L} \tag{10}$$

or $$R_{ki}=R+½log_2[SMR_{ki}]/[\Pi_{K=1}^{M}SMR_{ki}]^{1/L} \tag{11}$$

where $R_{ki}$ is k-th band in i-th sub-frame (i being 1 to L, k being 1 to $B_{max}$), and $$SMR_{ki}=P_{ki}/T_{ki} \tag{12}$$

where $P_{ki}$ is the input signal power in each divided band of i-th block, and $T_{ki}$ is the masking threshold for each critical band of i-th block.

In order that the bit number in the whole block is a predetermined value as given below, bit number adjustment is executed to confine the sub-frame assignment bit number between a lower limit bit number and an upper limit bit number.

$$\Sigma_{j=1}^{L}R_j=R_T \tag{13}$$

$$R_{min}<R_j<R_{max} \tag{14}$$

where $R_j$ is the number of bits assigned to j-th block, $R_T$ is the total bit number in a plurality of blocks (i.e., 4 blocks), $R_{min}$ is the lower limit bit number in the block, and $R_{max}$ is the upper limit bit number in the block. L is the number of blocks (i.e., 4 in this example). The bit assignment data obtained as a result of the above processing, is outputted to a vector quantization circuit 350 and also to a multiplexer 400.

The vector quantization circuit 350 has a plurality of excitation codebooks $\mathbf{360}_1$ to $\mathbf{360}_n$ different in the assignment bit number from a minimum bit number to a maximum bit number. The circuit 350 receives the assignment bit number data for each intra-block critical band, and selects a codebook according to the bit number. Then it selects an excitation codevector for each critical band to minimize the following $E_m$, $$E_m=\Sigma_{n-0}^{Nk-1}[X_k(n)-\gamma_{km}\cdot C_{km}(n)]^2 \quad (15)$$

where $X_k(n)$ is an MDCT coefficient contained in k-th critical band, $N_k$ is the number of MDCT coefficients contained in k-th critical band, and $\gamma_{km}$ is the optimum gain for codevector Ckm(n) (m being 0 to $2^{BK}-1$, Bk being the bit number of excitation codebook for k-th critical band). An index representing the selected excitation codevector is outputted to the multiplexer 400.

The excitation codebooks may be organized from Gaussian random numbers or by preliminary study. A method of codebook organization by study is taught in, for instance, Linde et al, "An Algorithm for Vector Quantization Design", IEEE Trans. COM-28, pp. 84–95, 1980 (Literature 3).

Using the selected excitation codevector $C_{km}(n)$ and a gain codebook 370, gain codevector minimizing $E_m$ of the following equation is retrieved for and outputted.

$$E_m=\Sigma_{n-0}^{Nk-1}[X_k(n)-g_{km}\cdot C_{km}(n)]^2 \quad (16)$$

where $g_{km}$ is m-th gain codevector in k-th critical band. An index of the selected gain codevector is outputted to the multiplexer 400.

The multiplexer 400 outputs in combination the output of the block length judging circuit 120, the output of the intra-block-inter-block bit assignment circuit 300, and the indexes of excitation codevector and gain codevector as the outputs of the vector quantization circuit 350.

Figure 2:
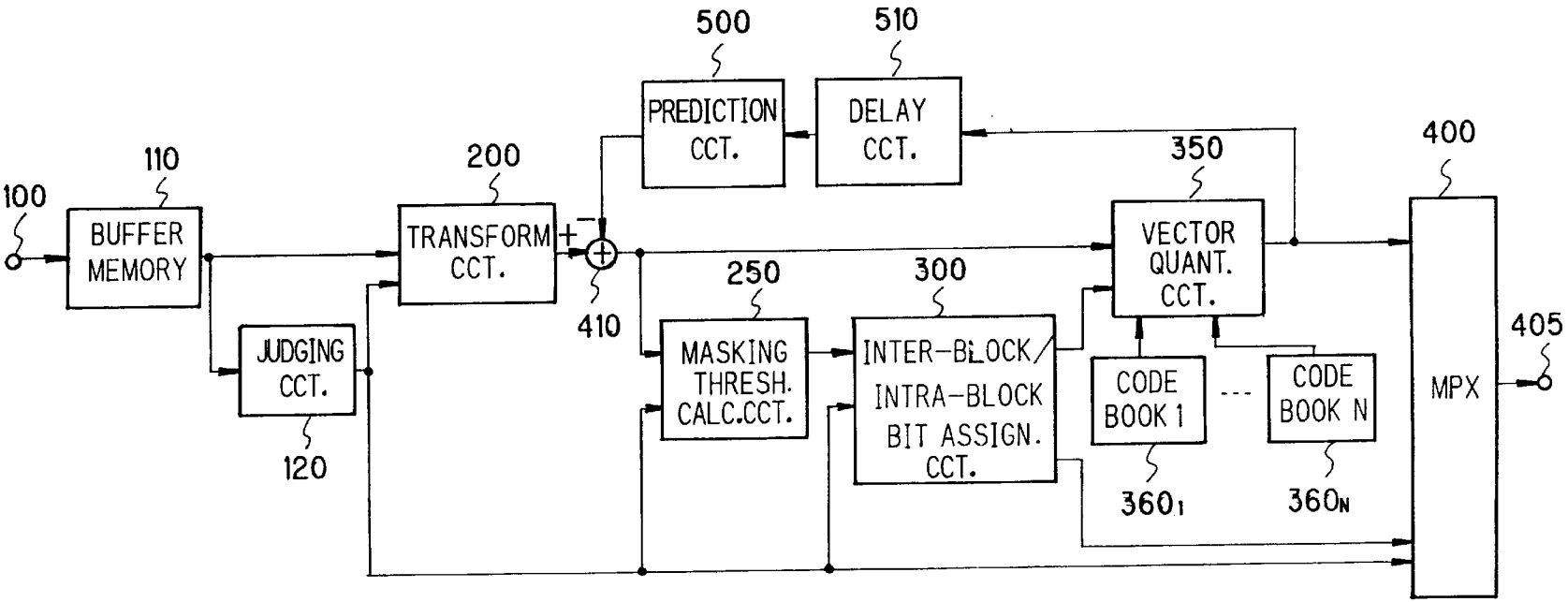
FIG. 2 is a block diagram showing an embodiment of the wide-band signal encoder according to a second aspect of the present invention.

FIG. 2 is a block diagram showing an embodiment of the wide-band signal encoder according to the second aspect of the present invention. In the Figure, constituent elements designated by reference numerals like those in FIG. 1 operate likewise, and are not described here.

A delay circuit 510 causes delay of the output Z'(k) of the vector quantization circuit 350 for a past block to an extent corresponding to a predetermined number of blocks. The number of blocks may be any number, but it is assumed to be one for the sake of the brevity of the description.

A prediction circuit 500 predicts the transform component by using the output $Z(k)'^{-1}$ of the delay circuit as $$Y(k)=A(k)\cdot Z(k)^{-1} \ (k=1 \ to \ L/2) \quad (17)$$

where A(K) is a prediction coefficient, and L is the block length. A(k) is designed beforehand with respect to a training signal. Y(k) is outputted to a subtractor 410.

The subtractor 410 calculates the prediction signal Y(k) from the output X(k) of the transform circuit 200 as follows and outputs a prediction error signal Z(k).

$$Z(k)=X(k)-Y(k) \ (k=1 \ to \ L/2) \quad (18)$$

Figure 3:
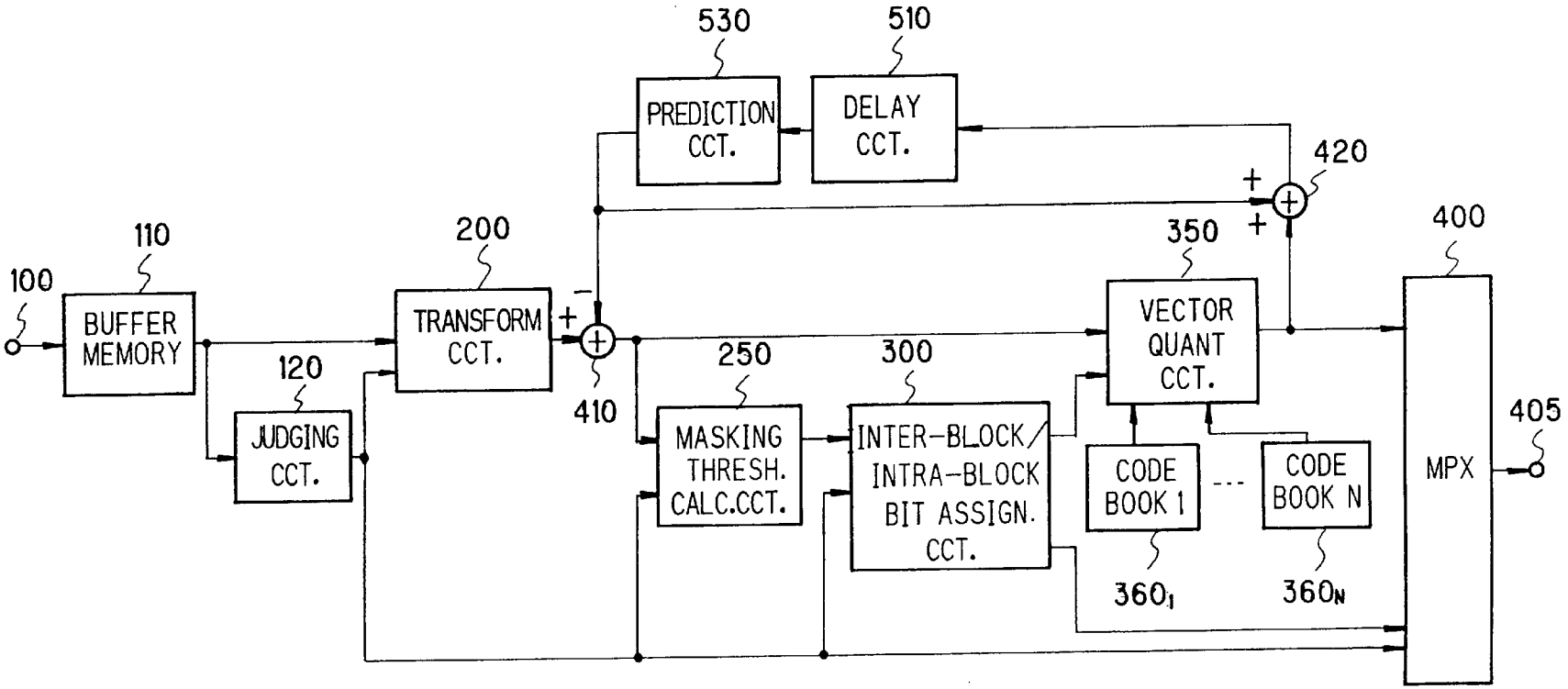
FIG. 3 is a block diagram showing a structure according to a third aspect of the present invention.

FIG. 3 is a block diagram showing a structure according to the third aspect of the present invention. In the Figure, constituent elements designated by reference numerals like those in FIGS. 1 and 2 operate likewise, and are not described here.

An adder 420 adds the output Y(k) of the prediction circuit 530 and the output Z'(k) of the vector quantization circuit 350 and outputs the sum S(k) to the delay circuit 510.

The prediction circuit 530 executes the prediction by using the output of the delay circuit 510 as follows.

$$Y(k)=B(k)\cdot S(k)^{-1} \ (k=1 \ to \ L/2) \quad (19)$$

where B(k) is a prediction coefficient, and L is the block length. B(k) is designed beforehand with respect to a training signal. Y(k) is outputted to the subtractor 410.

Figure 4:
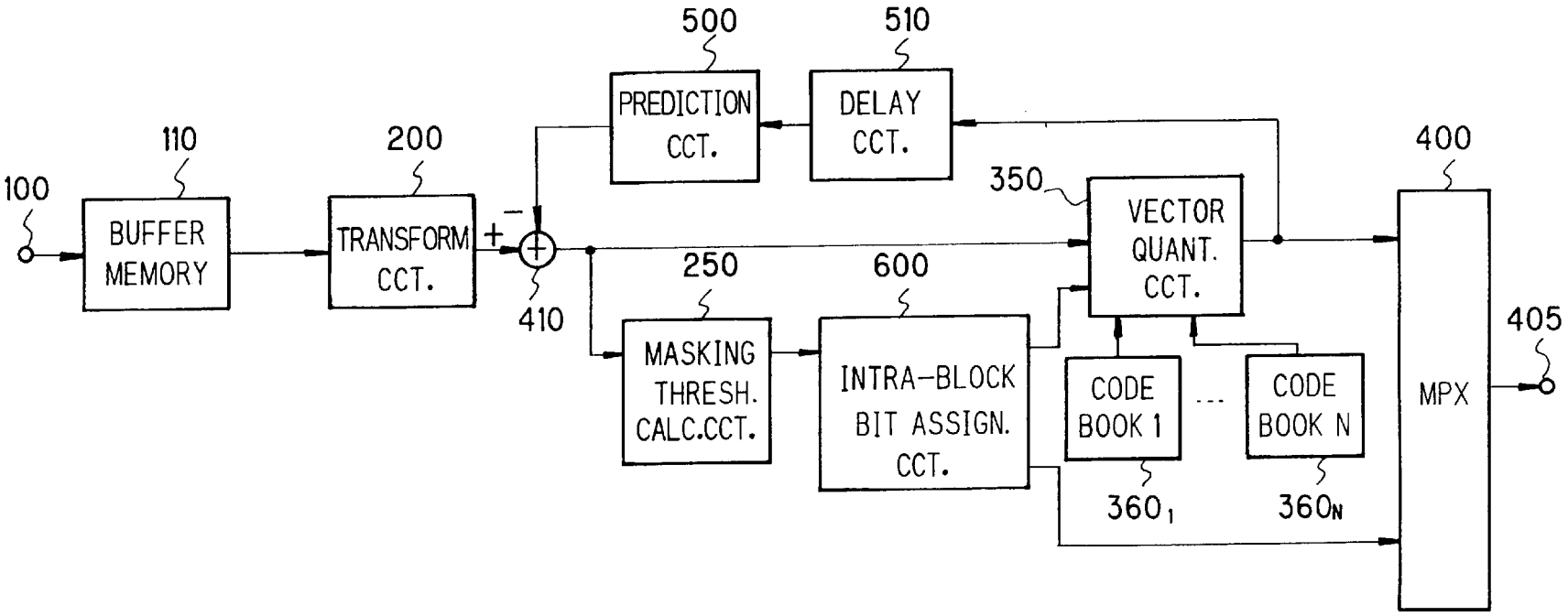
FIG. 4 is a block diagram showing a structure according to a fourth aspect of the present invention.

FIG. 4 is a block diagram showing a structure according to the fourth aspect of the present invention. In the Figure, constituent elements designated by reference numerals like those in FIG. 2 operate likewise, and are not described here. According to the fourth aspect of the present invention, the block length for transform is fixed, and also the total bit number of each block is fixed. This aspect of the present invention is different from the second aspect of the present invention in that the block length judging circuit 120 is unnecessary and that the sole intra-block bit assignment is made.

An intra-block bit assignment circuit 600 executes bit assignment with respect to transform component in each intra-block critical band on the basis of the equations (10) to (14).

Figure 5:
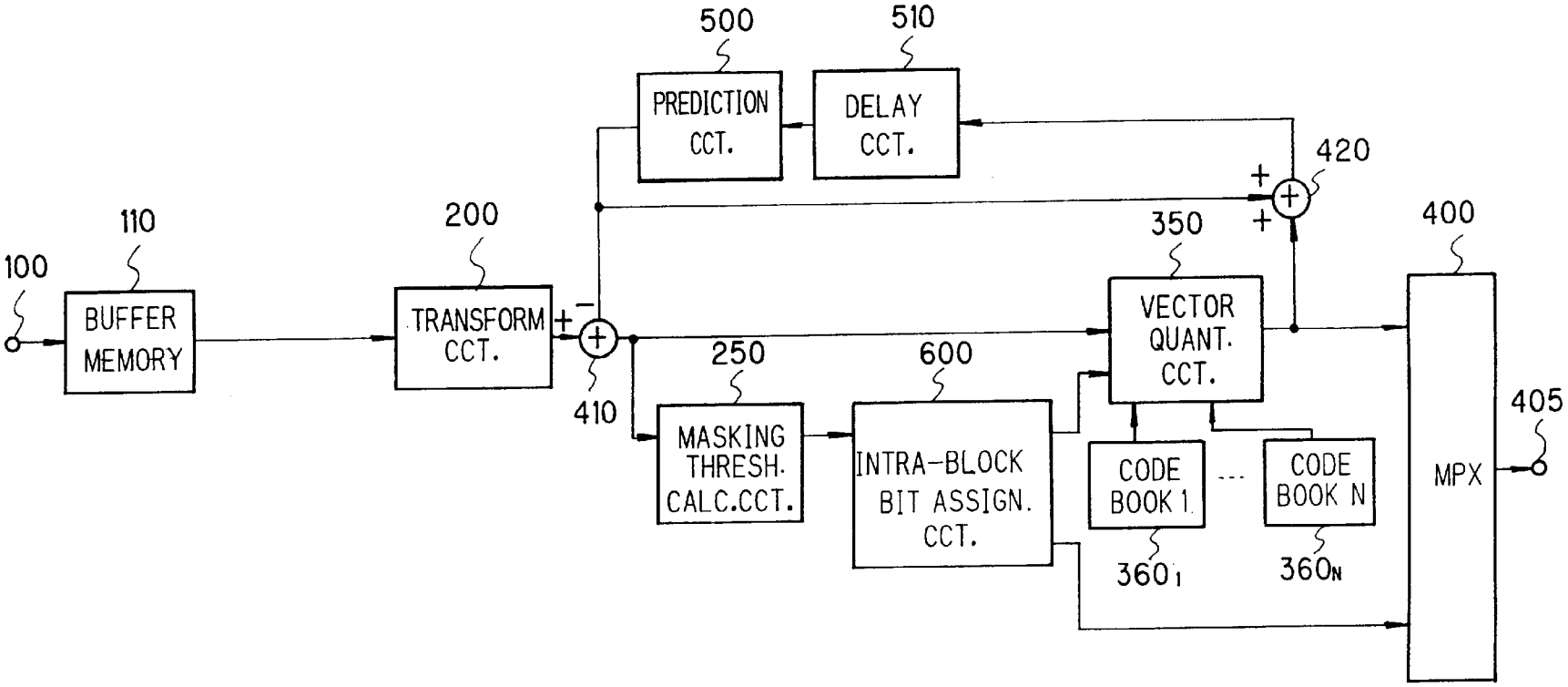
FIG. 5 is a block diagram showing a structure according to a fifth aspect of the present invention.

FIG. 5 is a block diagram showing a structure according to the fifth aspect of the present invention. In the Figure, constituent elements designated by reference numerals like those in FIGS. 3 and 4 operate likewise, and are not described here. According to the fifth aspect of the present invention, like the third aspect of the present invention, the block length for transform is fixed, and also the total bit number of each block is fixed. The differences from the third aspect of the present invention are that the block length judging circuit 120 is unnecessary and that the sole intra-block bit assignment is made.

Figure 6:
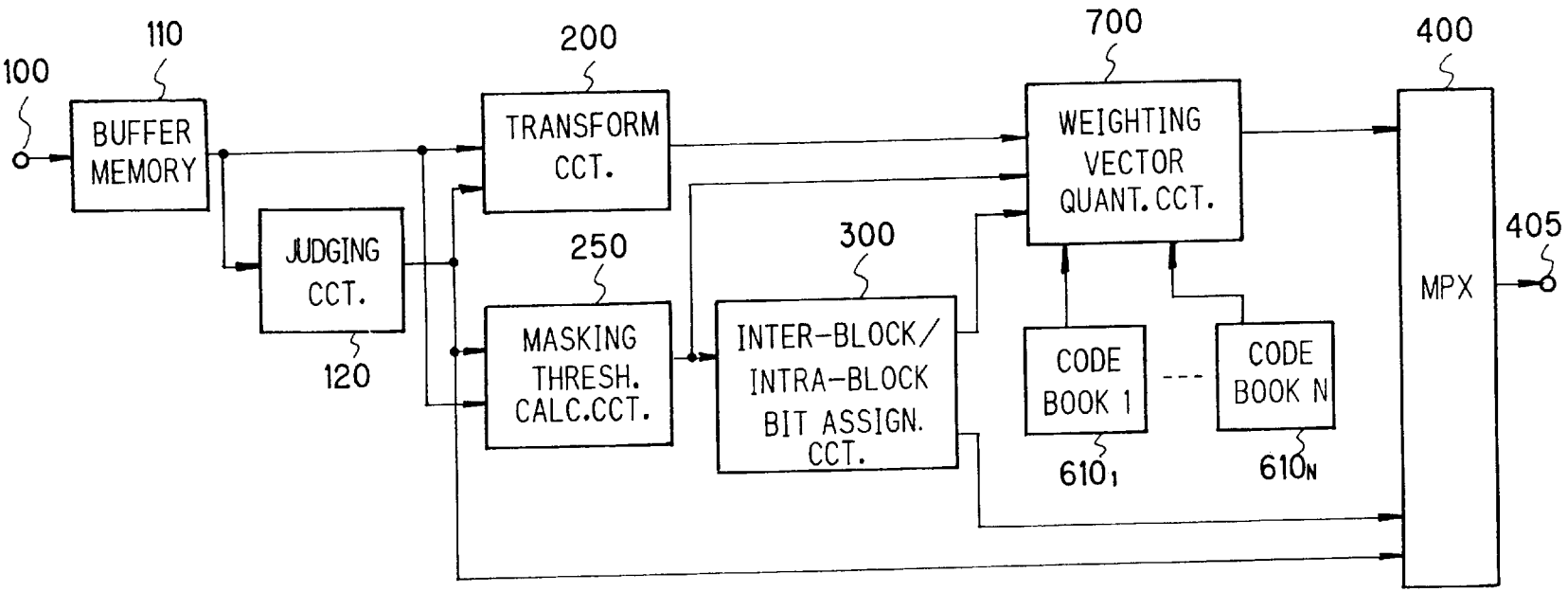
FIG. 6 is a block diagram showing a structure according to a sixth aspect of the present invention.

FIG. 6 is a block diagram showing a structure according to the sixth aspect of the present invention. This structure is different from the FIG. 1 structure according to the first aspect of the present invention in a weighting vector quantization circuit 700 and codebooks $\mathbf{610}_1$ to $\mathbf{610}_N$. The structure of the weighting vector quantization circuit 700 will now be described.

Figure 7:
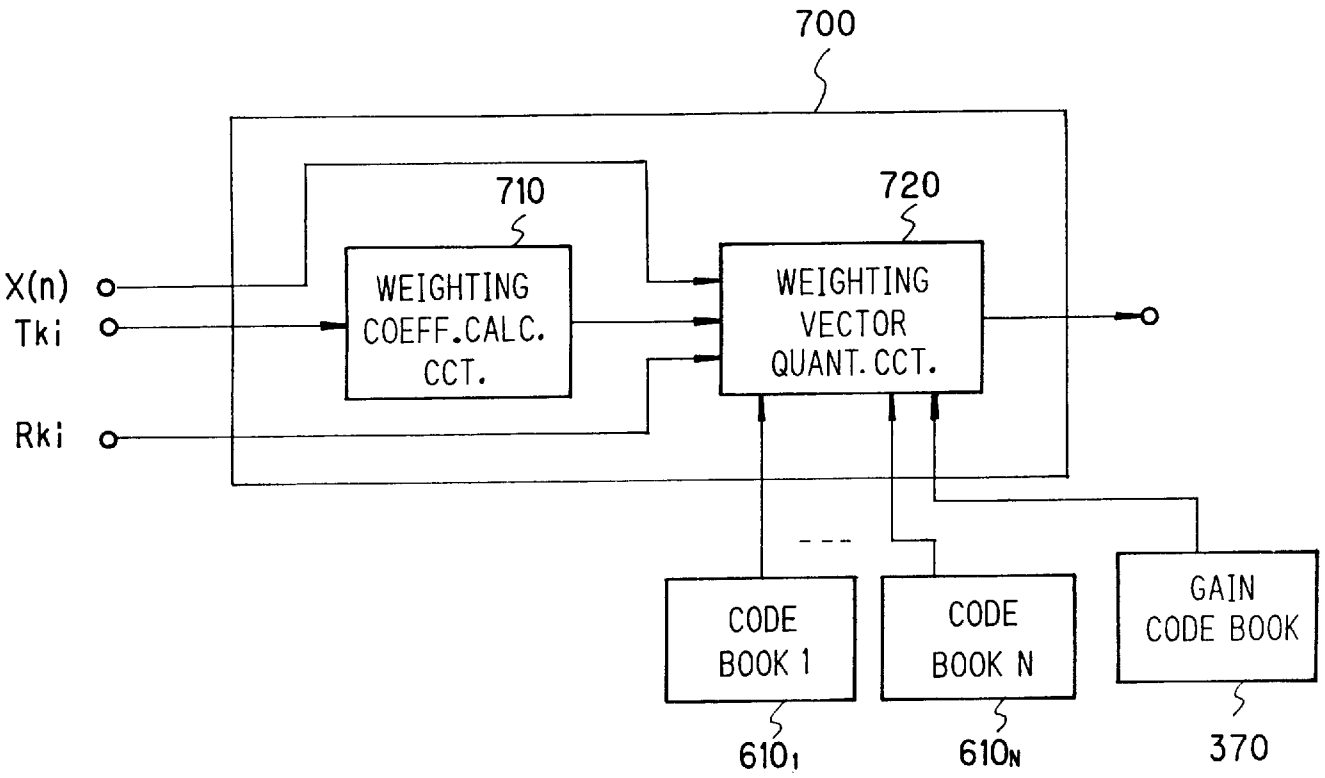
FIG. 7 is a block diagram showing an example of weighting vector quantization circuit 700.

FIG. 7 is a block diagram showing an example of the weighting vector quantization circuit 700. A weighting coefficient calculation circuit 710 receives masking threshold data $T_{ki}$ from the masking threshold calculating circuit 250 and calculates and outputs a weighting coefficient for the vector quantization. For the calculation, reference may be had to the following $$\eta_{ki}=1/T_{ki} \ (k-1 \ to \ B_{max})$$

where $B_{max}$ is the number of critical bands contained in one block.

A weighting vector quantization circuit 720 receives data of number $R_{ki}$ of bits assigned to k-th critical band in i-th block, selects one of codebooks $\mathbf{610}_1$ to $\mathbf{610}_N$ according to the bit number, and executes weighting vector quantization of transform coefficient X(n) as $$E_m=\Sigma_{n=0}^{Nk-1}[X_k(n)-\gamma_{km}\cdot C_{km}(n)]^2\cdot\eta_{ki} \quad (20)$$

Also, the circuit 720 executes gain quantization by using a gain codebook 370.

The weighting vector quantization circuit 700 may be added to the second to fifth aspects of the present invention by replacing the vector quantization circuit 350 with it.

Figure 8:
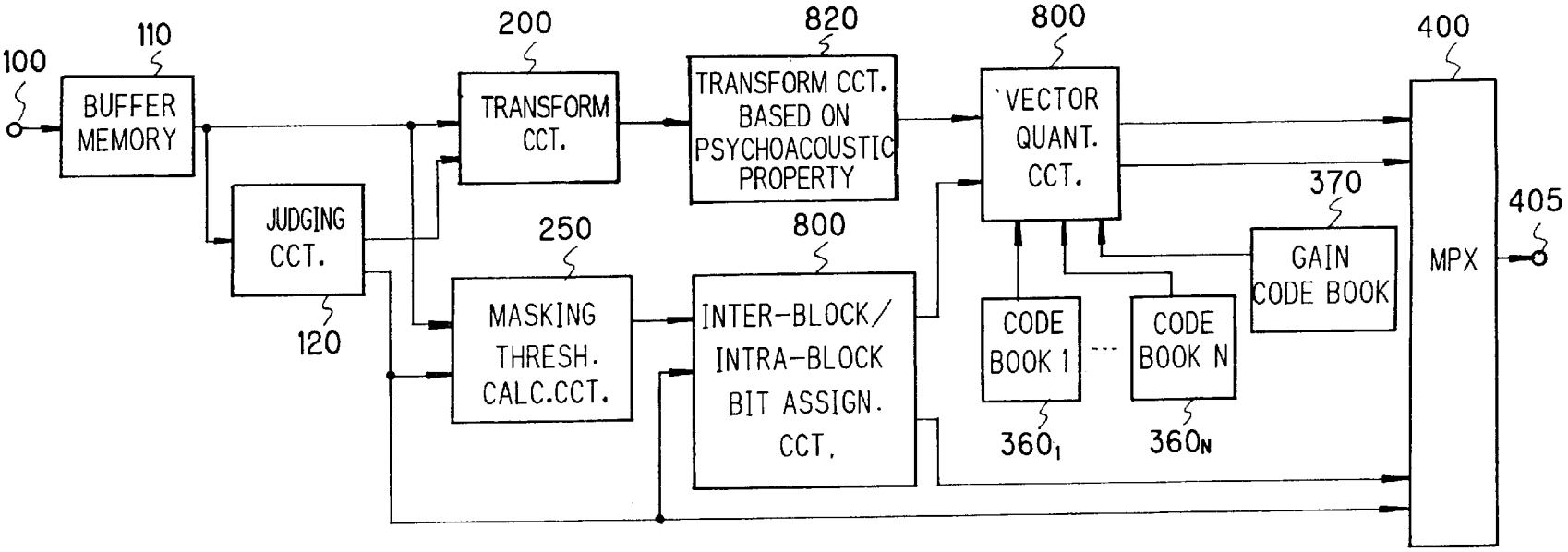
FIG. 8 is a block diagram showing a structure according to a seventh aspect of the present invention.

FIG. 8 is a block diagram showing a structure according to the seventh aspect of the present invention. In the case of this structure, a process based on psychoacoustical property is introduced to the first aspect of the present invention shown in FIG. 1.

A psychoacoustical property process circuit 820 executes transform based on psychoacoustical property with respect to the output X(n) of the transform circuit 200 as $$Q(n)=F[X(n)] \quad (21)$$

where F [X(n)] represents the transform based on psychoacoustical property. Specifically, such transforms as Burke's transform, masking process, loudness transform, etc. are conceivable. For details of these transforms, reference may be had to Wang et al, "An Objective Measure for Predicting Subjective Quality of Speech Coders", IEEE J. Sel. Areas. Commun., pp. 819–829, 1992 (Literature 4), and these transforms are not described herein.

A vector quantization circuit 800 switches codebooks $\mathbf{360}_1$ to $\mathbf{360}_N$ according to the assignment bit number data received for each critical band in each block from the inter-block/intra-block bit assignment circuit 300, and vector quantizes Q(n) as $$E_m=\Sigma_{n=0}^{Nk-1}[Q_k(n)-\gamma_{km}\cdot F[C_{km}(n)]]^2 \quad (22)$$

Here, use is made of a method of codevector retrieval while executing transform based on psychoacoustical property with respect to codevector $C_{km}(n)$ received from the codebook. In a case where the codevector obtained as a result of transform on the basis of psychoacoustical property, i.e., codevector $F[C_{km}(n)]$, is stored in advance in the codebook, the vector quantization given as $$E_m=\Sigma_{n=0}^{Nk-1}[Q_k(n)-\gamma_{km}\cdot P_{km}(n)]^2 \quad (23)$$

may be executed. Here $$P_{km}(n)=F[C_{km}(n)] \quad (24)$$

After the codevector retrieval, gain $\gamma_{km}$ may be quantized using the gain codevector 370.

The process based on psychoacoustical property may be introduced to the second to fifth aspects of the present invention by replacing the vector quantization circuit 350 with the vector quantization circuit 800 and adding a psychoacoustical property process circuit 820 to the input section of the circuit 800.

Figure 9:
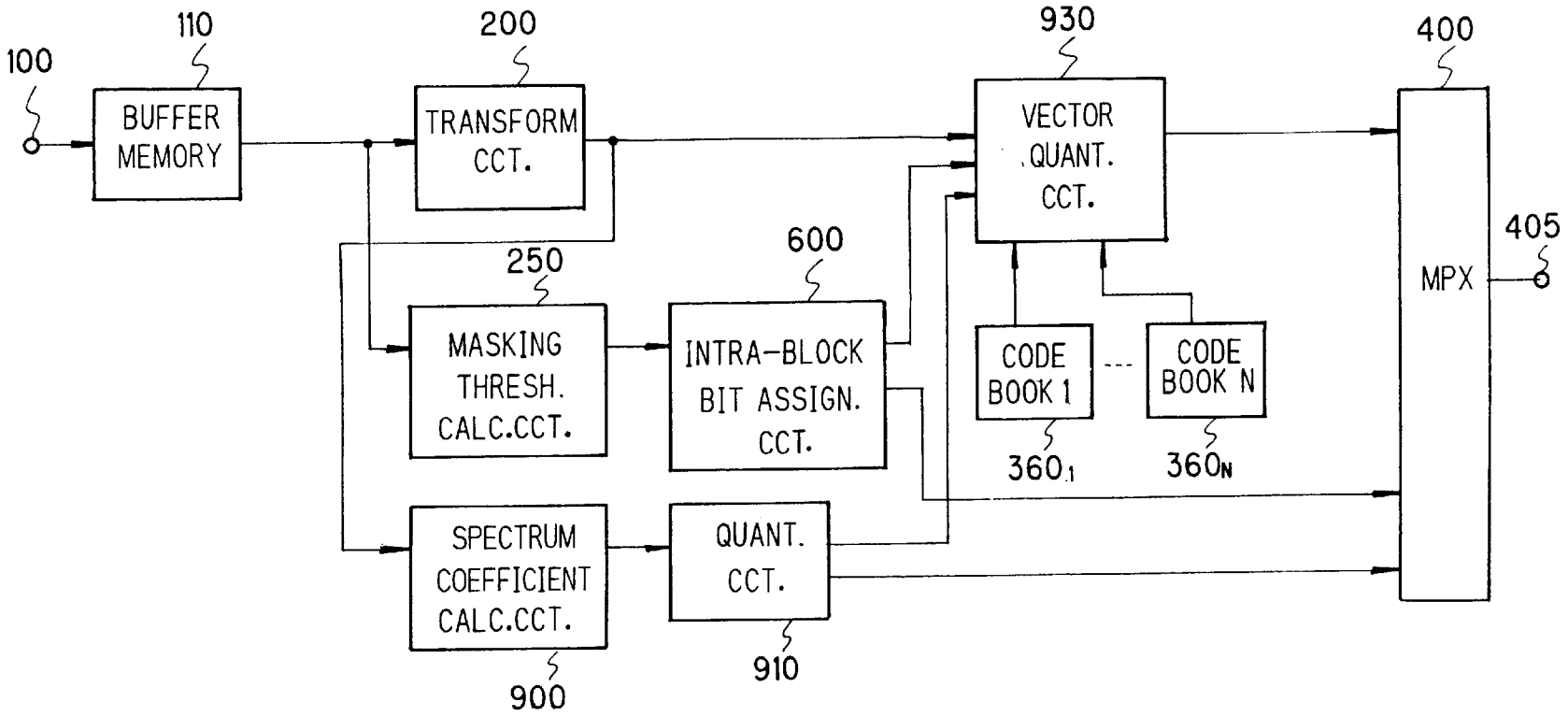
FIG. 9 is a block diagram showing a structure according to an eighth aspect of the present invention.

FIG. 9 is a block diagram showing a structure according to the eighth aspect of the present invention. In the Figure, constituent elements designated by reference numerals like those in FIG. 1 operate likewise, and are not described here.

A spectrum coefficient calculating circuit 900 calculates a low degree spectrum coefficient, which approximates the frequency envelope of MDCT coefficient X(n) (n being 1 to L) as the output of the transform circuit 200. As the spectrum coefficient, LPC (Linear Prediction Coefficient), cepstrum, mercepstrum, etc. are well known in the art. It is hereinunder assumed that LPC is used. Square $X^2(n)$ (n=1 to L) of each MDCT coefficient is subjected to inverse MDCT or inverse FFT to obtain self-correlation R(n). The self-correlation R(n) is taken up to a predetermined degree $\tau$, and LPC coefficient $\alpha(i)$ (i being 1 to $\tau$) is calculated from R(n) that is taken by using self-correlation process.

A quantizing circuit 910 quantizes the LPC coefficient. The circuit 910 preliminarily converts the LPC coefficient into LSP (Line Spectrum Pair) coefficient having a higher quantization efficiency for quantization with a predetermined number of bits. For the conversion of the LPC coefficient to the LSP coefficient, reference may be had to Sugamura et al, "Quantizer Design in LSP Speech Analysis-Synthesis", IEEE J. Sel. Areas in Commun., pp. 432–440, 1988 (Literature 5). The quantization may be scaler quantization or vector quantization. The index of the quantized LSP is outputted to the multiplexer 400. In addition, the quantized LSP is decoded and then inversely converted to $LPC\alpha'(i)$ (i being 1 to $\tau$). $LPC\alpha'(i)$ thus obtained is then subjected to MDCT or FFT for calculating frequency spectrum H(n) (n being 1 to L/2), which is outputted to a vector quantization circuit 930.

The vector quantization circuit 930 normalizes the output X(n) of the transform circuit 200 by using spectrum H(n).

$$X'(n)=X(n)/H(n)\ (n=1\ to\ L/2) \quad (25)$$

Then it executes vector quantization of X'(n) by using codebook.

$$E_m=\Sigma_{n=0}^{Nk-1}[X'_k(n)-C_{km}(n)]^2 \quad (26)$$

The spectrum H(n) used has an effect of normalizing the gain, so that no gain codebook is required.

The FIG. 9 structure may also use the block length judging circuit 120 for switching block length and the inter-block/intra-block bit assignment circuit 300.

Figure 10:
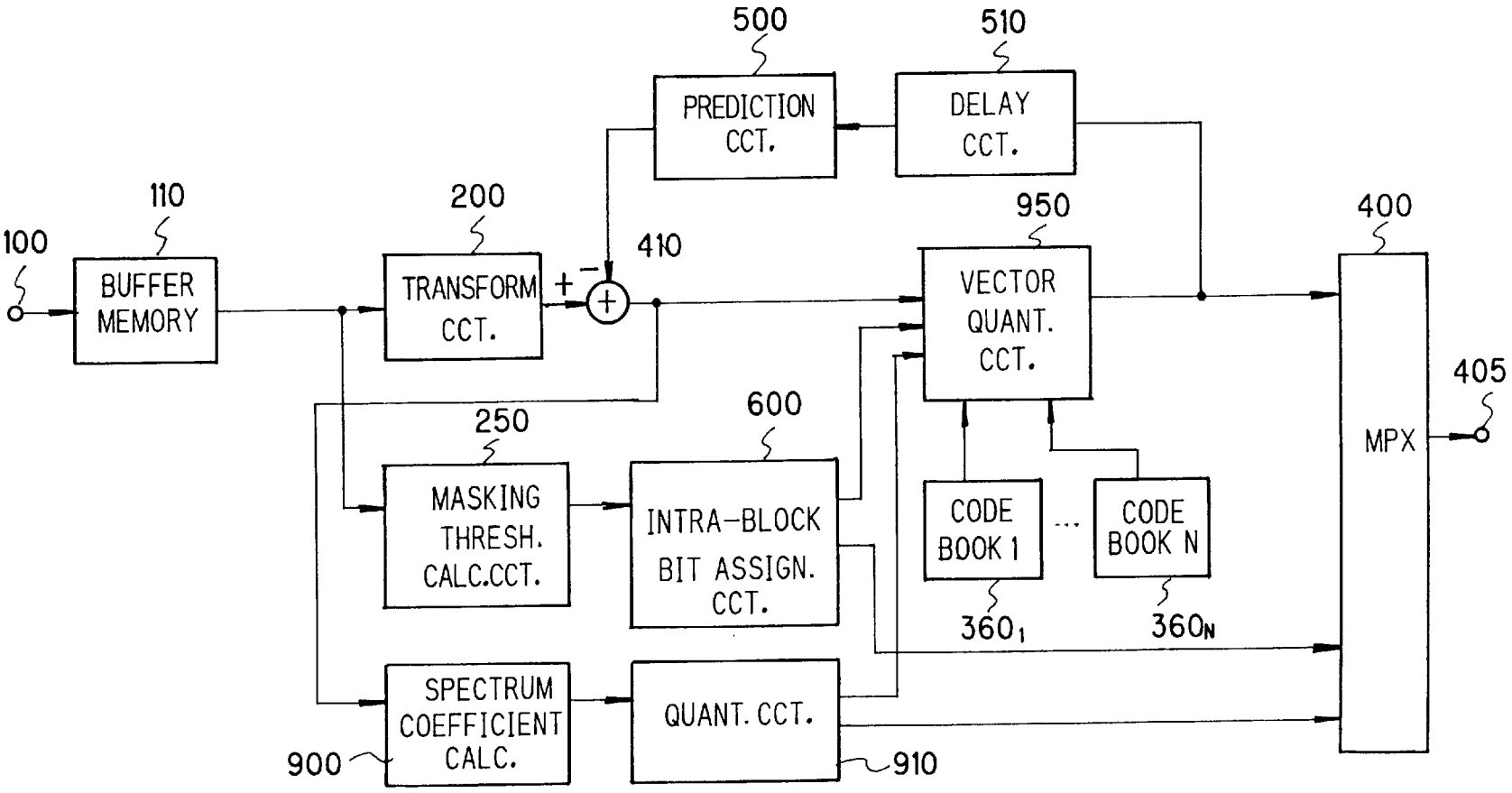
FIG. 10 is a block diagram showing an arrangement in which prediction error signal is quantized.

FIG. 10 is a block diagram showing an arrangement in which prediction error signal is quantized. In the Figure, constituent elements designated by reference numerals like those in FIGS. 1 and 9 operate likewise, and are not described here.

In this case, a vector quantization circuit 950 normalizes the prediction error signal Z(n) as the output of the subtractor 410.

$$Z'(n)=Z(n)/H(n)\ (n=1\ to\ L/2) \quad (27)$$

Then, vector quantization of Z'(n) is made by selecting a codevector which minimizes $$E_m=\Sigma_{n=0}^{Nk-1}[Z'_k(n)-C_{km}(n)]^2 \quad (28)$$

The FIG. 10 structure may also use the block length judging circuit 120 for switching the block lengths and the inter-block/-intra-block bit assignment circuit 300. As a further alternative of the prediction, the prediction error signal may be calculated by using the FIG. 3 method.

According to the present invention as described above, as a method of bit assignment determination it is possible to design bit assignment codebooks corresponding in number to a predetermined number of patterns (for instance $2^B$, B being a bit number indicative of pattern) by clustering SMR and tabulating each cluster of SMR and each assignment bit number and permit these codebooks to be used in the bit assignment circuit for the bit assignment calculation. With this arrangement, the bit assignment information to be transmitted may only be B bits per block, and thus it is possible to reduce the bit assignment information to be transmitted.

A further alternative is that the vector quantization circuit 350 may vector quantize the transform coefficient or the prediction error signal by using a different extent measure. A still further alternative is that the weighting vector quantization using the masking threshold according to the sixth aspect of the present invention, may be made by using a different weighting extent measure.

A further alternative is that the intra-block bit assignment according to the first to eighth aspects of the present invention, may be made for each predetermined section instead of each critical band.

A yet further alternative is that the bit assignment for each inter-block and/or intra-block critical band according to the first to third, sixth and seventh aspects of the present invention, may be made by using an equation other than the equation (4), for instance $$R_{kj}=R+\tfrac{1}{2}\log_2[\Pi_{m-1}^{Q_k}SMR_{kmj}]/[\Pi_{j-1}^{L}\Pi_{m-1}^{Q_k}SMR_{kmj}]^{1/QL} \quad (29)$$

where $Q_k$ is the number of critical bands contained in k-th division band.

As an alternative of the bit assignment method in the bit assignment circuit, it is possible that after making preliminary bit assignment on the basis of the equations (8) to (12), the quantization using a codebook corresponding to the actually assigned bit number is executed for measuring quantized noise and adjusting the bit assignment such as to maximize $$MNR_j=[\Pi_{i=1}^{M-1}SMR_{ij}]^{1/M}/\sigma_{nj}^2 \quad (30)$$

where $\sigma_{nj}^2$ is quantized noise measured in j-th sub-frame.

The above masking threshold spectrum calculation method may be replaced with a different well-known method.

The masking threshold calculating circuit 250 may use a band division filter group in lieu of the Fourier Transform in order to reduce the amount of operations. For the band division, QMFs (Quadrature Mirror Filters) are used. The QMF is detailed in P. Vaidyanathan et al, "Multirate Digital Filters, Filter Banks, Polyphase Networks, and Applications: A Tutorial", Proc. IEEE, pp. 56–93, 1990 (Literature 6).

As has been described in the foregoing, according to the present invention the transform coefficient or the prediction error signal obtained by predicting the transform coefficient is vector quantized after making the inter-block and/or intra-block bit number assignment. It is thus possible to obtain satisfactory coding of a wide-band signal even with a lower bit rate than in the prior art. In addition, according to the present invention reduction of auxiliary information is possible by expressing the transform coefficient or prediction error signal frequency envelope with a low degree spectrum coefficient, thus permitting realization of lower bit rates than in the prior art.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

What is claimed is:

1. A wide-band signal encoder comprising:

a block length judging circuit for determining a block length based on a feature quantity obtained from an input signal;

a transform circuit for executing transform of the input signal into frequency components through division of the input signal into a plurality of blocks having a predetermined time length;

a masking threshold calculating circuit for obtaining a masking threshold from the output of the transform circuit and the input signal on the basis of an acoustical masking characteristic;

a bit assignment circuit for determining an inter-block quantization bit number and/or an intra-block quantization bit number in a predetermined section not shorter than the block length on the basis of the obtained masking threshold; and a vector quantization circuit for quantizing the output signal of the transform circuit according to the output of the bit assignment circuit.

2. The wide-band signal encoder according to claim 1, wherein the vector quantization circuit executes vector quantization of the output signal from the transform circuit while weighting the signal by using the masking threshold.

3. The wide-band signal encoder according to claim 1, wherein the vector quantization circuit executes vector quantization of the output signal from the transform circuit after processing the signal with a transformation based on psychoacoustical property.

4. The wide-band signal encoder according to claim 1, wherein the vector quantization circuit further comprises:

a spectrum coefficient calculating circuit for obtaining a small degree spectrum coefficient representing a frequency envelope of the output signal from the transform circuit; and a quantizing circuit for quantizing the output signal from the transform circuit by using the frequency envelope and the output of the bit assignment circuit.

5. A wide-band signal encoder comprising;

a block length judging circuit for determining a block length based on a feature quantity obtained from an input signal;

a transform circuit for executing transform of the input signal into frequency components through division of the input signal into a plurality of blocks;

a prediction circuit for obtaining a prediction error by predicting the output signal of the transform circuit for a present block from a quantized output signal for a past block;

a masking threshold calculating circuit for obtaining a masking threshold from a difference signal that corresponds to a difference between the output of the transform circuit and the prediction error signal on the basis of an acoustical masking characteristic;

a bit assignment circuit for determining an inter-block quantization bit number and/or an intra-block quantization bit number in a predetermined section not shorter than the block length on the basis of the obtained masking threshold; and a vector quantization circuit for quantizing the difference signal according to the output of the bit assignment circuit.

6. The wide-band signal encoder according to claim 5, wherein the vector quantization circuit executes vector quantization of the difference signal while weighting the difference signal by using the masking threshold.

7. The wide-band signal encoder according to claim 5, wherein the vector quantization circuit executes vector quantization of the difference signal after processing the difference signal with a transformation based on psychoacoustical property.

8. The wide-band signal encoder according to claim 5, wherein the vector quantization circuit further comprises:

a spectrum coefficient calculating circuit for obtaining a small degree spectrum coefficient representing a frequency envelope of the difference signal; and a quantizing circuit for quantizing the difference signal by using the frequency envelope and the output of the bit assignment circuit.

9. A wide-band signal encoder comprising:

a block length judging circuit for determining a block length based on a feature quantity obtained from an input signal;

a transform circuit for executing transform of the input signal into frequency components through division of the input signal into a plurality of blocks;

a prediction circuit for obtaining a prediction error by calculating a prediction signal corresponding to the transform circuit output signal for a present block by using a quantized output signal for a past block and a prediction signal for the past block;

a masking threshold calculating circuit for obtaining a masking threshold from a difference signal that corresponds to a difference between the output of the transform circuit and the prediction error signal on the basis of an acoustical masking characteristic;

a bit assignment circuit for determining an inter-block quantization bit number and/or an intra-block quantization bit number in a predetermined section not shorter than the block length on the basis of the obtained masking threshold; and a vector quantization circuit for quantizing the difference signal according to the output of the bit assignment circuit.

10. The wide-band signal encoder according to claim 9, wherein the vector quantization circuit executes vector quantization of the difference signal while weighting the difference signal by using the masking threshold.

11. The wide-band signal encoder according to claim 9, wherein the vector quantization circuit executes vector quantization of the difference signal after processing the difference signal with a transformation based on psychoacoustical property.

12. The wide-band signal encoder according to claim 9, wherein the vector quantization circuit further comprises:

a spectrum coefficient calculating circuit for obtaining a small degree spectrum coefficient representing a frequency envelope of the difference signal; and a quantizing circuit for quantizing the difference signal by using the frequency envelope and the output of the bit assignment circuit.

13. A wide-band signal encoder comprising:

a transform circuit for executing transform of the input signal into frequency components through division of the input signal into a plurality of blocks;

a prediction circuit for obtaining a prediction error by predicting an output signal of the transform circuit for a present block from a quantized output signal for a past block;

a masking threshold calculating circuit for obtaining a masking threshold from a difference signal that corresponds to a difference between the output of the transform circuit and the prediction error signal on the basis of an acoustical masking characteristic;

a bit assignment circuit for determining an intra-block quantization bit number on the basis of the obtained masking threshold; and a vector quantization circuit for quantizing the difference signal according to the output of the bit assignment circuit.

14. The wide-band signal encoder according to claim 13, wherein the vector quantization circuit executes vector quantization of the difference signal while weighting the difference signal by using the masking threshold.

15. The wide-band signal encoder according to claim 13, wherein the vector quantization circuit executes vector quantization of the difference signal after processing the difference signal with a transformation based on psychoacoustical property.

16. The wide-band signal encoder according to claim 13, wherein the vector quantization circuit further comprises:

a spectrum coefficient calculating circuit for obtaining a small degree spectrum coefficient representing a frequency envelope of the difference signal; and a quantizing circuit for quantizing the difference signal by using the frequency envelope and the output of the bit assignment circuit.

17. A wide-band signal encoder comprising:

a transform circuit for executing transform of the input signal into frequency components through division of the input signal into a plurality of blocks;

a prediction circuit for obtaining a prediction error by calculating a prediction signal for a present block from a quantized output signal for a past block and a prediction signal for the past block;

a masking threshold calculating circuit for obtaining a masking threshold from a difference signal that corresponds to a difference between the output of the transform circuit and the prediction error signal on the basis of an acoustical masking characteristic;

a bit assignment circuit for determining an intra-block quantization bit number on the basis of the obtained masking threshold; and a vector quantization circuit for quantizing the difference signal according to the output of the bit assignment circuit.

18. The wide-band signal encoder according to claim 17, wherein the vector quantization circuit executes vector quantization of the difference signal while weighting the difference signal by using the masking threshold.

19. The wide-band signal encoder according to claim 17, wherein the vector quantization circuit executes vector quantization of the difference signal after processing the difference signal with a transformation based on psychoacoustical property.

20. The wide-band signal encoder according to claim 17, wherein the vector quantization circuit further comprises:

a spectrum coefficient calculating circuit for obtaining a small degree spectrum coefficient representing a frequency envelope of the difference signal; and a quantizing circuit for quantizing the difference signal by using the frequency envelope and the output of the bit assignment circuit.

* * * * *